US011927432B2

(12) United States Patent
Azar et al.

(10) Patent No.: US 11,927,432 B2
(45) Date of Patent: Mar. 12, 2024

(54) MOLDED POWER CHARGE WITH SECONDARY PELLET AT EACH END

(71) Applicant: Pyrotechnics Research Center, LLC, Houston, TX (US)

(72) Inventors: Ghassan Azar, Houston, TX (US); Johnny Esquibel, Houston, TX (US); Andy Pearce, Houston, TX (US)

(73) Assignee: PYROTECHNICS RESEARCH CENTER LLC, Midland, TX (US)

( * ) Notice: Subject to any disclaimer, the term of this patent is extended or adjusted under 35 U.S.C. 154(b) by 0 days.

(21) Appl. No.: 17/085,706

(22) Filed: Oct. 30, 2020

(65) Prior Publication Data

US 2022/0276031 A1 Sep. 1, 2022

Related U.S. Application Data

(60) Provisional application No. 62/948,581, filed on Dec. 16, 2019, provisional application No. 62/927,782, filed on Oct. 30, 2019.

(51) Int. Cl.

| | |
|---|---|
| ***F42B 3/26*** | (2006.01) |
| ***F42B 3/11*** | (2006.01) |
| *E21B 23/04* | (2006.01) |

(52) U.S. Cl.
CPC ..... *F42B 3/26* (2013.01); *F42B 3/11* (2013.01); *E21B 23/0414* (2020.05)

(58) Field of Classification Search
None
See application file for complete search history.

(56) References Cited

U.S. PATENT DOCUMENTS

| | | | | |
|---|---|---|---|---|
| 7,565,930 | B2 * | 7/2009 | Seekford | F42B 3/28 102/317 |
| 9,447,672 | B2 * | 9/2016 | Arrell, Jr. | F42B 1/00 |
| 9,453,382 | B2 * | 9/2016 | Carr | E21B 23/065 |

FOREIGN PATENT DOCUMENTS

| | | | | |
|---|---|---|---|---|
| WO | WO-2021030594 A1 * | 2/2021 | | E21B 23/0414 |

* cited by examiner

*Primary Examiner* — Reginald S Tillman, Jr.
(74) *Attorney, Agent, or Firm* — Braxton Perrone, PLLC; Bobby W. Braxton; Gregory Perrone

(57) ABSTRACT

A system for a molded power charge with secondary pellet at each end. The molded power charge includes a solid outer wall which extends for the length. The solid outer wall has a first end and a second end. The power charge further includes a secondary pellet at each end. The first end and the second end of the outer wall include a secondary pellet with an exposed face. This allows the power charge to be ignited from either end.

16 Claims, 1 Drawing Sheet

MOLDED POWER CHARGE WITH SECONDARY PELLET AT EACH END

PRIORITY

The present invention claims priority to U.S. Provisional Application No. 62/927,782 filed Oct. 30, 2019 and U.S. Provisional Application No. 62/948,581 filed Dec. 16, 2019, the entirety of both of which are hereby incorporated by reference.

TECHNICAL FIELD

The present invention relates to a system and method for a power charge.

DESCRIPTION OF RELATED ART

Power charges are inserted in downhole tools for a variety of purposes. Power charges are inserted into downhole setting assemblies via wireline or other device and are used to provide a motive force for downhole setting assemblies. Power charges are often used at all hours of the day and night, often by operators who have been working a long shift. Consequently, there is a need for an improved power charge.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Power charges have widespread use in the oil and gas industry. They can be used in setting tools to set plugs, packers, etc. When burned the power charge creates pressure greater than 10,000 psi. The pressure causes a tool to stroke, setting plug, packers, ect in the desired place or performing any such desired task.

Figure 1:
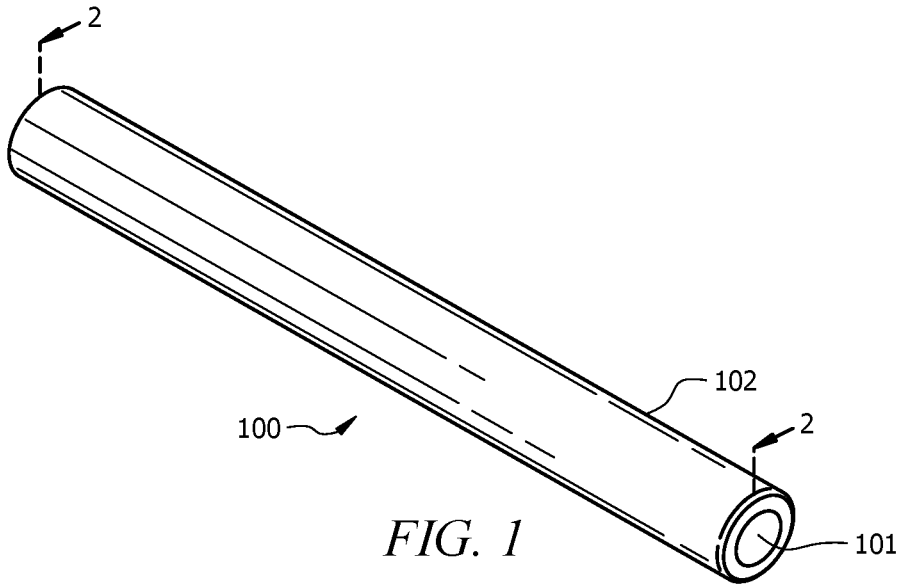
FIG. 1 is a perspective view of a power charge system in one embodiment.

FIG. 1 is a perspective view of a power charge system in one embodiment. As seen the power charge system 100 is cylindrical. This is for illustrative purposes only and should not be deemed limiting. The power charge system 100 can comprise a cross-section of virtually any shape including circular, oval, triangular, square, etc. In the embodiment depicted the power charge system 100 is cylindrical so it can be placed into downhole setting assemblies.

The power charge system 100 in FIG. 1 has an outer wall 102. The outer wall 102 serves several functions. First, the outer wall on 102 acts to secure the contents of the power charge system 100, as discussed in more detail below. The power charge system 100 can be handled, moved, etc. without spilling the contents because of the outer wall 102. Second, the outer wall 102 provides a structure, and specifically a void which can be filled with the secondary charge 103.

The outer wall 102 can comprise virtually any combustible material. The outer wall 102 can comprise paper, plastic, cardboard, etc. Virtually any material which can burn can be utilized as the outer wall 102.

In one embodiment in FIG. 1 the outer wall 102 extends longitudinally along the entire length of the power charge system 100. In this fashion, the outer wall acts to contain the internal contents.

As noted, in one embodiment the power charge system 100 comprises at least one secondary pellet 101. In one embodiment the power charge system 100 is contained and held together by any means of epoxy or resin within the confines of the outer wall 102.

The power charge 103 is the combustible material placed within the outer wall 102 of the power charge system 100. The power charge 103 substance is the combustible substance which is placed in a power charge system 100. The power charge 103 can comprise virtually any combustible substance. The ratio and contents of the ingredients can be adjusted depending upon the application. The ingredients can include sodium nitrate, potassium nitrate, Pyrodex, manufactured by Hodgdon Powder Company, located in Minden Louisiana, wheat flour, and other ingredients. While Pyrodex is disclosed, this is for illustrative purposes only and should not be deemed limiting. Other black powder and black powder substitutes can likewise be utilized. In one embodiment the power charge 103 does not comprise Pyrodex. The ingredients can form a consistency similar to dough. In one embodiment the power charge has an off-white color. The ingredients can further include a binder or epoxy to help the dough harden or cure. The binder or epoxy provides the strength necessary to retain the desired shape.

Once the power charge 103 is thoroughly mixed, it is transported to a casing mold to be formed to the desirable length and shape with secondary pellet 101 placed at each end.

Figure 2:
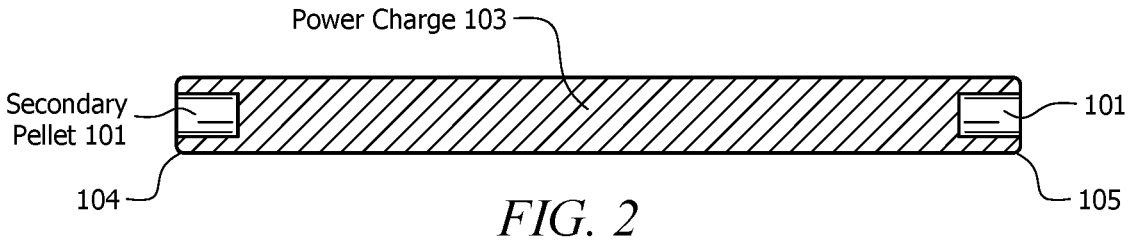
FIG. 2 is a cross-sectional view of a power charge in one embodiment.

FIG. 2 is a cross-sectional view of a power charge in one embodiment. As can be seen in FIG. 2 the molded power charge 103 with secondary pellet 101 fills the void of the FIG. 1 power charge system 100 with the outer wall 102 and one secondary pellet.

FIG. 2 as depicted the secondary pellet 101 comprises a first end 104 and an opposing second end 105. In one embodiment the power charge 103 extends continuously from the first end 104 to the opposing second end 105. In one embodiment the molded power charge 103 is filled so as to ensure there are no bubbles, gaps, or voids, within.

As shown, each end 104, 105 of the power charge system 100 comprises of a secondary pellet 101. A secondary pellet 101 is a material which can be readily ignited by an electrical charge which will cause the power charge 103 to ignite. Various materials known in the art can be used in the secondary pellet 101. In one embodiment the secondary pellet 101 consist primarily of Pyrodex, but other black powder and black powder substitutes can be utilized.

A secondary pellet 101 is located at each end of the power charge system 100. In one embodiment at least an external face of each secondary pellet 101 is exposed at either end and is accessible externally. This allows an electrical charge to be applied to the primary igniter 101 to ignite the power charge system 100. The electrical lines can be coupled to the power charge system 100 via any method or device known in the art.

As can be seen, the secondary pellet 101 on the first end 104 begins with an exposed outer face. As noted, this means the secondary pellet 101 has an external face which is accessible, and visible, on either end. This allows for an ignition source from either side of the power charge 103 for the secondary pellet 101. The secondary pellet 101 then extends downstream into power charge system 100. As used herein, upstream and downstream refer to relative locations along the power charge system. An item closer to the first end will be referred to as the upstream end whereas an object further away from the first end will be referred to as downstream. Thus, the second end 105 is downstream of the first end 104. As can be seen, the secondary pellet 101 extends downstream into the power charge. As depicted, the upstream end of the secondary pellet 101 is less than the diameter of the power charge 103. Thus, the molded power charge 103 fills in the gap between the secondary pellet 104 and the power charge 103.

As depicted the secondary pellet 101 comprises a uniform diameter, however this is for illustrative purposes and should not be deemed limiting. Thus, while the secondary pellet 101 is shown as being of cylindrical shape with uniform diameter, other shapes can also be utilized.

The size and length of the secondary pellet 101 is the distance that it extends into the power charge system 100 depending upon the application. As depicted, the length of the secondary pellet 101 is less than about 10% of the total length of the power charge system 100. As noted, this is for illustrative purposes only and should not be deemed limiting.

In one embodiment the secondary pellet 101 has an outer diameter of between about 0.5 to about 1 inch. In one embodiment the secondary pellet 101 has an outer diameter of about 0.717 inches. The length of the pellet, the dimensions that is parallel with the length of the power charge system 100, can range from about ⅝ to about 1.25 inches.

The amount of the secondary pellet 101 relative to the power charge system 100 can vary depending upon the application. Various sizes of power charge systems 100 are used for various applications. However, in one embodiment, the weight of the secondary pellet 101 remains unchanged even when a larger power charge system 100 is utilized. This is because the amount of secondary pellet 101 to ignite the power charge substance 103 does not change in one embodiment. Thus, in one embodiment 365 grams of power charge substance 103 are added to the power charge system 100. Each secondary pellet 101 will weigh between about 6-18 grams. Thus, the total weight of the secondary pellets 101 will vary, in one embodiment between 12-36 grams. Even in embodiments wherein 675 grams of power charge substance 103 is added to the power charge system 100, the weight of the secondary pellets 101 remains consistent at 12-36 grams. This specific weight is obviously dependent upon the ingredients and should not be deemed limiting.

In one embodiment the secondary pellets 101 are visibly different than the combustible power charge substance 103. This helps the user differentiate where the secondary pellets 101 end and begin. Further, as depicted, and in one embodiment, the secondary pellets 101 are separated by a distance. They are not directly adjacent to one another, and they are not touching. Instead, they are separated a distance which is filled with a power charge substance 103.

The secondary pellet 101 can be placed into the power charge 103 via any method or device known in the art. As an example, in one embodiment the power charge 103 is molded and thereafter the secondary pellets 101 are placed in the power charge 103 at each end. In one embodiment a first secondary pellet 101 is placed in one end. The power charge substance 103 is then added. Subsequently, the second secondary pellet 101 is placed at the second end.

As noted, and as depicted, the power charge system 100 comprises a secondary pellet 101 at each end. Thus, there is a secondary pellet in the first end 104, and a secondary pellet at the second end 105. Thus, in one embodiment, the power charge system 100 comprises mirror images if cut down the middle. Put differently, the power charge system 100 has a length which is measured as the longest dimension depicted in FIG. 2. The height is perpendicular to the length. In one embodiment the power charge system 100 is symmetrical when the length is cut in half. Thus, the left half looks identical to the right half. In one embodiment the left half is identical in dimensions to the right half. Likewise, in one embodiment the power charge system 100 is symmetrical when the height is cut in half.

Having a secondary pellet 101 at each end provides a plurality of benefits and unexpected advantages. First, it increases safety. When oil workers are loading a power charge 103, in a downhole setting assembly they are often working long hours. Often this work takes place at night where vision might be compromised. If a power charge system 100 only had a secondary pellet 101 on one end, then the power charge system 100 had to be properly loaded in the correct orientation or the power charge system 100 would not ignite when desired. In such a scenario, as an example, the end with the secondary pellet 101 would be placed downhole first. This means the end without the secondary pellet is the end which is adjacent to the electrical igniter which provides the ignition source to the secondary pellet 101. When the circuit is closed to allow for electrical igniter to ignite there would be no power charge 103 ignition because the secondary pellet 101 was on the wrong end. The tool would then need to be pulled back up to surface so it could be re-loaded.

This exercise is a waste of time, resources, and is very stressful. When a charge is applied to an electrical igniter to ignite the secondary pellet 101 then the power charge system 100 and it fails, retrieval is similar to retrieving a firecracker which failed to explode. Everyone is very cautious and nervous about retrieving the power charge which they believe may ignite when it is pulled back up the hole.

This scenario is avoided if either end of the power charge system 100 has a secondary pellet. In this fashion, it does not matter which end is loaded first—either end will ignite. This reduces the possibility that an operator will make an expensive and time-consuming mistake of loading the power charge system 100 in the wrong direction.

Thus, as noted, safety is increased because it reduces the need to retrieve a power charge system 100 which failed to ignite. Aside from safety, it is very time consuming to string a tool and deploy it downhole. When that tool cannot properly be placed or sealed because of a failed power charge, it takes time to retrieve that tool. The cost involved in such an exercise includes personnel costs, tool costs, equipment rentals, lost revenue, etc. Avoiding such costs results in significant savings.

Another benefit is that there are no downsides for having a secondary pellet 101 at each end. The power charge system 100 still functions as it did previously, but now with the added benefit that it can be loaded in any direction. This eliminates the potential that the power charge system 100 can be incorrectly loaded.

While the invention has been particularly shown and described with reference to a preferred embodiment, it will be understood by those skilled in the art that various changes in form and detail may be made therein without departing from the spirit and scope of the invention.

What is claimed is:

1. A system for a power charge, said system comprising:

an outer tube filled with a combustible power charge, wherein said power charge system comprises a first end and a second end;

wherein said first end comprises a first secondary pellet with an exposed face; and wherein said second end comprises a second secondary pellet with an exposed face;

and wherein said first and secondary pellets comprise Pyrodex;

wherein said first secondary pellet and said second secondary pellet extends into the outer tube.

2. The system of claim 1 wherein said first and second secondary pellets are not adjacent and are not touching, but are instead separated by combustible power charge.

3. The system of claim 1 wherein said first and second secondary pellets are visibly different from said combustible power charge.

4. The system of claim 1 wherein said combustible power charge comprises Pyrodex.

5. The system of claim 1 wherein said power charge system is cylindrical.

6. The system of claim 1 wherein said power charge system comprises a length, and wherein said first secondary pellet comprises a length, and wherein said length of said first secondary pellet is less than 20% of the length of said power charge system.

7. The system of claim 1 wherein said power charge system is symmetrical when split in half by its length.

8. The system of claim 7 wherein said power charge system is symmetrical when split in half by its height.

9. The system of claim 1 wherein said system has a length, and wherein said outer wall extends longitudinally along the entire length of the system.

10. The system of claim 1 wherein said power charge has a diameter, and wherein said first secondary pellet has a diameter which is less than the power charge's diameter.

11. The system of claim 1 wherein said first secondary pellet and said second secondary pellet each weight between 6-18 grams.

12. The system of claim 11 wherein said combustible power charge weights about 675 grams.

13. The system of claim 11 wherein said combustible power charge weights about 365 grams.

14. The system of claim 1 for use in a setting tool.

15. The system of claim 1 wherein said first secondary pellet and said second secondary pellet each comprise a uniform diameter.

16. The system of claim 15 wherein said first secondary pellet and said second secondary pellet each comprise a cylindrical shape.

* * * * *